US011524860B2

(12) United States Patent
Lazzareschi

(10) Patent No.: US 11,524,860 B2
(45) Date of Patent: Dec. 13, 2022

(54) EXTRACTION ASSEMBLY OF A CORE FROM A LOG, CONVERTING LINE HAVING SAID ASSEMBLY AND METHOD FOR PRODUCING A CORELESS LOG

(71) Applicant: GAMBINI S.P.A., Milan (IT)

(72) Inventor: Paolo Lazzareschi, Lucca (IT)

(73) Assignee: GAMBINI S.P.A., Milan (IT)

( * ) Notice: Subject to any disclaimer, the term of this patent is extended or adjusted under 35 U.S.C. 154(b) by 162 days.

(21) Appl. No.: 17/086,509

(22) Filed: Nov. 2, 2020

(65) Prior Publication Data

US 2021/0147169 A1 May 20, 2021

(30) Foreign Application Priority Data

Nov. 18, 2019 (IT) ..... 102019000021438

(51) Int. Cl.
*B65H 19/30* (2006.01)
*B65H 19/22* (2006.01)

(52) U.S. Cl.
CPC ..... *B65H 19/2292* (2013.01); *B65H 2301/41812* (2013.01); *B65H 2301/41852* (2013.01)

(58) Field of Classification Search
CPC ..... B65H 19/30; B65H 19/2292; B65H 2301/41812; B65H 2301/41852
See application file for complete search history.

(56) References Cited

U.S. PATENT DOCUMENTS 6,047,916 A * 4/2000 Onnerlov ..... B65H 19/2261 242/534
6,565,033 B1 5/2003 Biagiotti
8,042,761 B2 * 10/2011 Wojcik ..... B65H 19/30 242/541.3

(Continued)

FOREIGN PATENT DOCUMENTS

JP 6171808 A 6/1994
JP 6327584 A 11/1994
JP 101241 A 1/1998

OTHER PUBLICATIONS

Search Report dated Jul. 10, 2020 in Italian Patent Application No. 201900021438, 2 pages (with English translation of Categories of Cited Documents).

*Primary Examiner* — Sang K Kim
(74) *Attorney, Agent, or Firm* — Element IP, PLC

(57) ABSTRACT

Disclosed herein is an extraction assembly for producing coreless logs. The extraction assembly includes a rectilinear transporter (20) of a log (11) wound about a disintegrable core (12), and a gripping device (30) for a portion of the core (12) projecting from the log (11), wherein the rectilinear transporter (20) has a transverse transport direction with respect to a log advancement direction of the log (11) along the converting line (100), and has an alternating transport direction back and forth in opposite directions, and the rectilinear transporter (20) contains a first portion for being received within the converting line (100), and a second portion for being placed outside the converting line (100), in which the second portion is aligned with respect to the first portion along the transverse transport direction. Also disclosed herein are a converting line containing the extraction assembly, and methods for producing coreless logs.

20 Claims, 6 Drawing Sheets

(56) References Cited

U.S. PATENT DOCUMENTS

| | | | | |
|---|---|---|---|---|
| 2003/0080234 | A1* | 5/2003 | Baggot | B65H 18/22<br>242/532.3 |
| 2005/0097966 | A1* | 5/2005 | Sartain | B65H 26/00<br>73/818 |
| 2013/0333183 | A1 | 12/2013 | Mazzaccherini et al. | |
| 2016/0114996 | A1 | 4/2016 | Jendroska | |

* cited by examiner

EXTRACTION ASSEMBLY OF A CORE FROM A LOG, CONVERTING LINE HAVING SAID ASSEMBLY AND METHOD FOR PRODUCING A CORELESS LOG

The present invention relates to an extraction assembly of a core from a log, to a converting line having said assembly and to a method for producing a coreless log.

The tissue converting sector involves the production of paper rolls for domestic use, such as rolls of toilet paper or kitchen paper, as well as the production of paper rolls for industrial use, both with an internal and without a cardboard core, the so-called "coreless" products, i.e. without a core.

The so-called paper "logs" are made by winding one or more paper plies in a rewinder, stably binding the final edge at the end of the winding in a gluer device and then cutting the log into many small rolls in a cutter, the so-called "little rolls", which can have different sizes depending on the use.

According to a first type of rewinder, the paper plies are wound about a cardboard core which is supplied at the inlet into the rewinder and to which the paper web being wound is bound by glue at the beginning of the winding, i.e. in the so-called exchange step.

According to another type of rewinder, the paper is not wound about a cardboard core, but on spindles, for example in plastic material, which are then removed from the logs at the end of the winding and supplied back at the inlet into the rewinder through a special recirculation system.

In addition, paper rolls are available on the market, generally for industrial use, already cut to size and provided with a particular cardboard core, of the so-called "strippable" or "separable" type, which is suitable for being removed directly by the final user at the moment of use of the paper roll by pulling on the same. The paper roll thus prepared for use, allows the paper contained in it to be used by unwinding the roll from the inside and not from the outside.

The separable cardboard cores are made up of webs with reduced mutual adhesion and have weakening lines, which allow the breakage of the core itself and its consequent transformation into a strip. In particular, after winding the paper about the core and cutting the roll to size, the application of traction on the piece of core breaks the core which is extracted in the form of a spiral wound strip.

A drawback of the current production technology of coreless rolls concerns the criticality of the exchange step, in which the paper web must be made to adhere to a spindle of synthetic material.

Another criticality is then constituted by the subsequent separation of the spindle from the paper web at the end of the winding operation.

The recirculation system of the spindles then requires special equipment of considerable size and with its own additional maintenance.

The current coreless rewinders dedicated to winding tissue paper on spindles have specific structural technical solutions for this need. They are therefore not suitable, unless with complex technical adaptations, for carrying out the winding about cardboard cores.

Finally, there are coreless rewinders which provide for using half metal spindles which form a single spindle jointed in the centre and which are extracted from both sides at the end of the winding, to then be re-coupled before being inserted into the rewinder.

The aim of the present invention is to provide an extraction assembly of a core from a log, a converting line having said assembly and a method for producing a coreless log which solve the drawbacks of the aforementioned prior art.

Another aim of the present invention is to provide an extraction assembly of a core from a log, a converting line having said assembly and a method for producing a coreless log that allow converting the production from products with a core to coreless products as quickly as possible and minimizing the necessary adjustments.

Another aim of the present invention is to provide an extraction assembly of a core from a log, a converting line having said assembly and a particularly simple and functional method for producing a coreless log, with reduced costs.

These aims according to the present invention are achieved by providing an extraction assembly of a core from a log, a converting line having said assembly and a method for producing a coreless log as set out in the independent claims.

Further characteristics are comprised in the dependent claims.

The characteristics and the advantages of an extraction assembly of a core from a log, a converting line having said assembly and a method for producing a coreless log according to the present invention will become more evident from the following exemplary and non-limiting description, referring to the attached schematic drawings in which.

Figure 4:
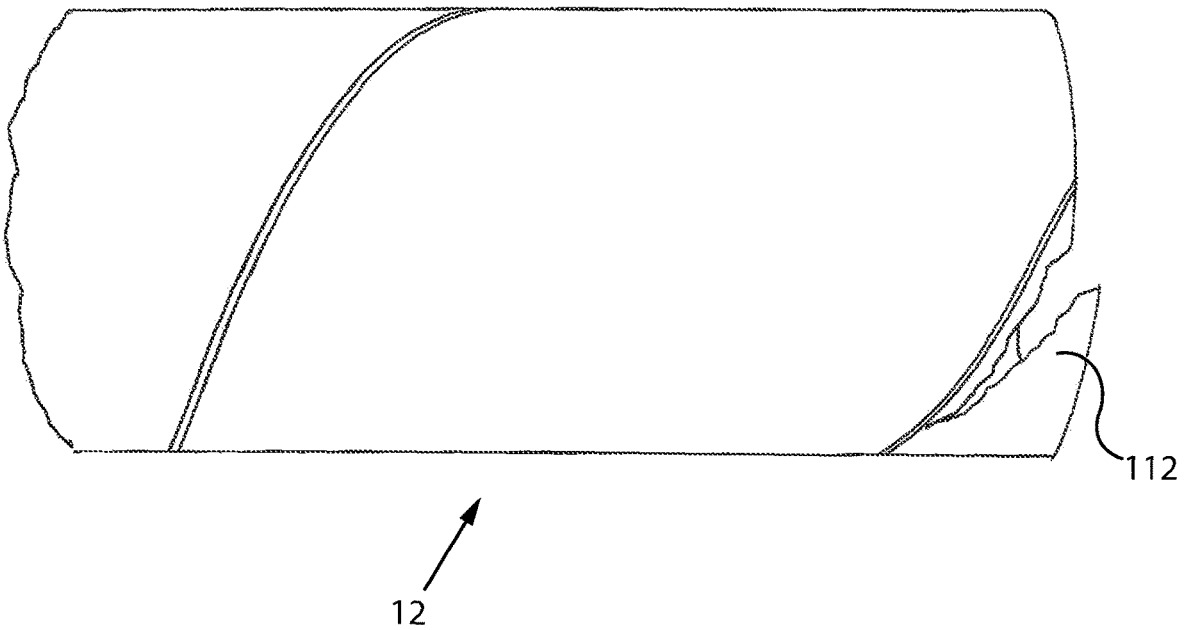

FIGS. 3A to 3D schematically show the main steps of the method for producing a coreless log, object of the invention;

FIG. 4 shows an enlarged detail of the gripping area of the robotic gripper on the cardboard core.

With reference to the figures, an extraction assembly of a core from a log, a converting line having said assembly and a method for producing a coreless log are shown.

In particular, the extraction assembly of a core from a log is indicated as a whole with 10 and the converting line with 100.

Figure 1A:
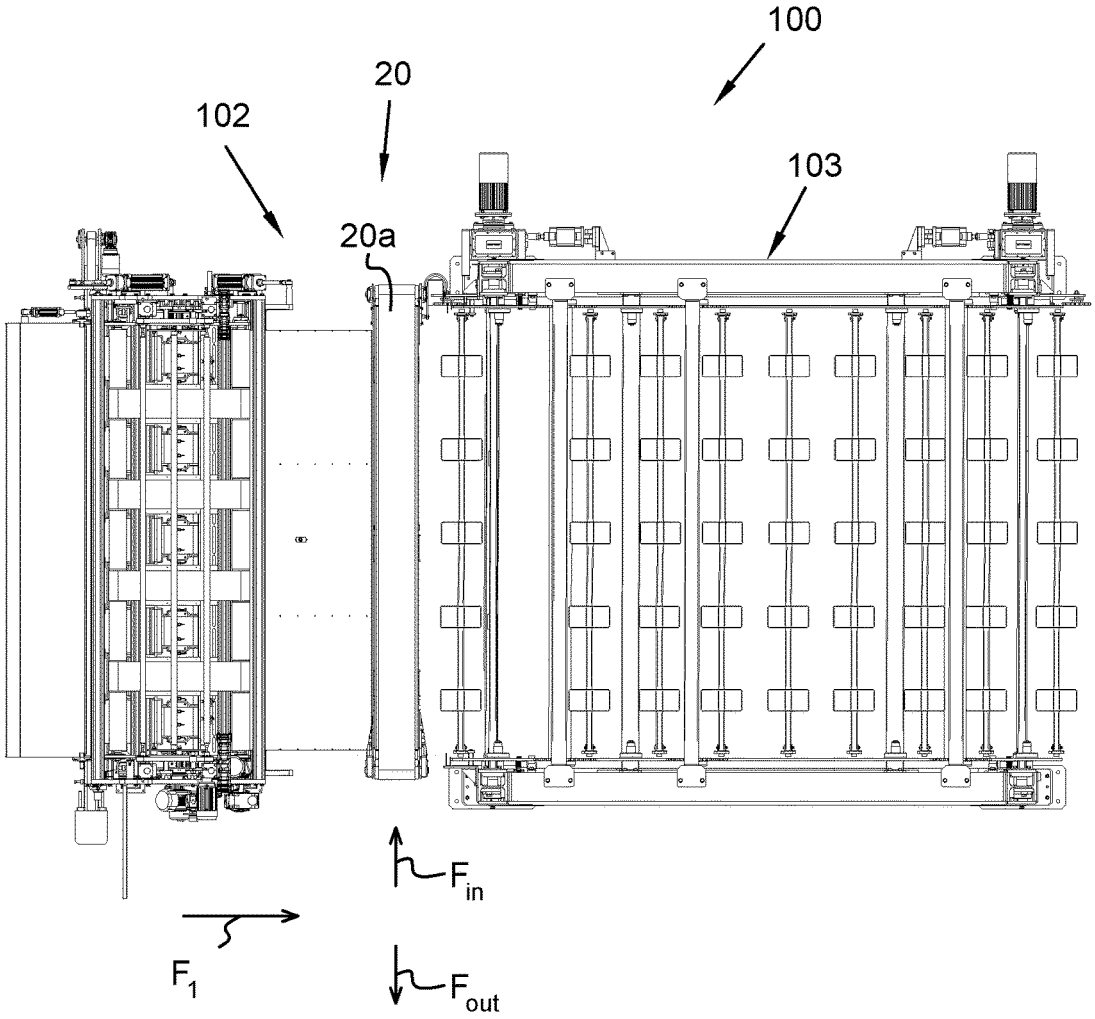
FIG. 1A is a schematic plan view of a part of a converting line having an extraction assembly of a core from a log, according to a first embodiment of the invention, in which the representation of the log has been omitted.
Figure 1A:
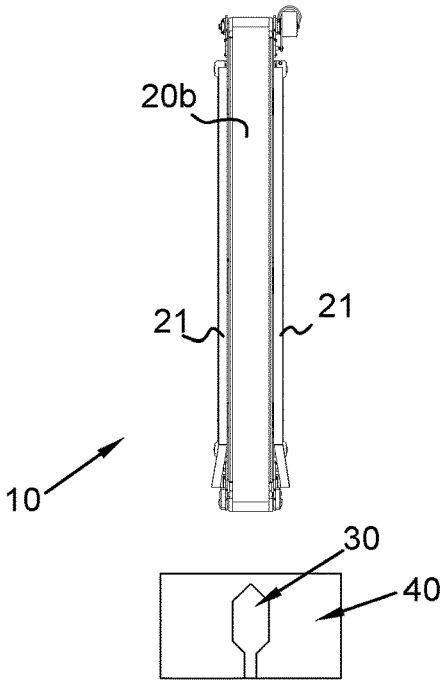
Figure 1B:
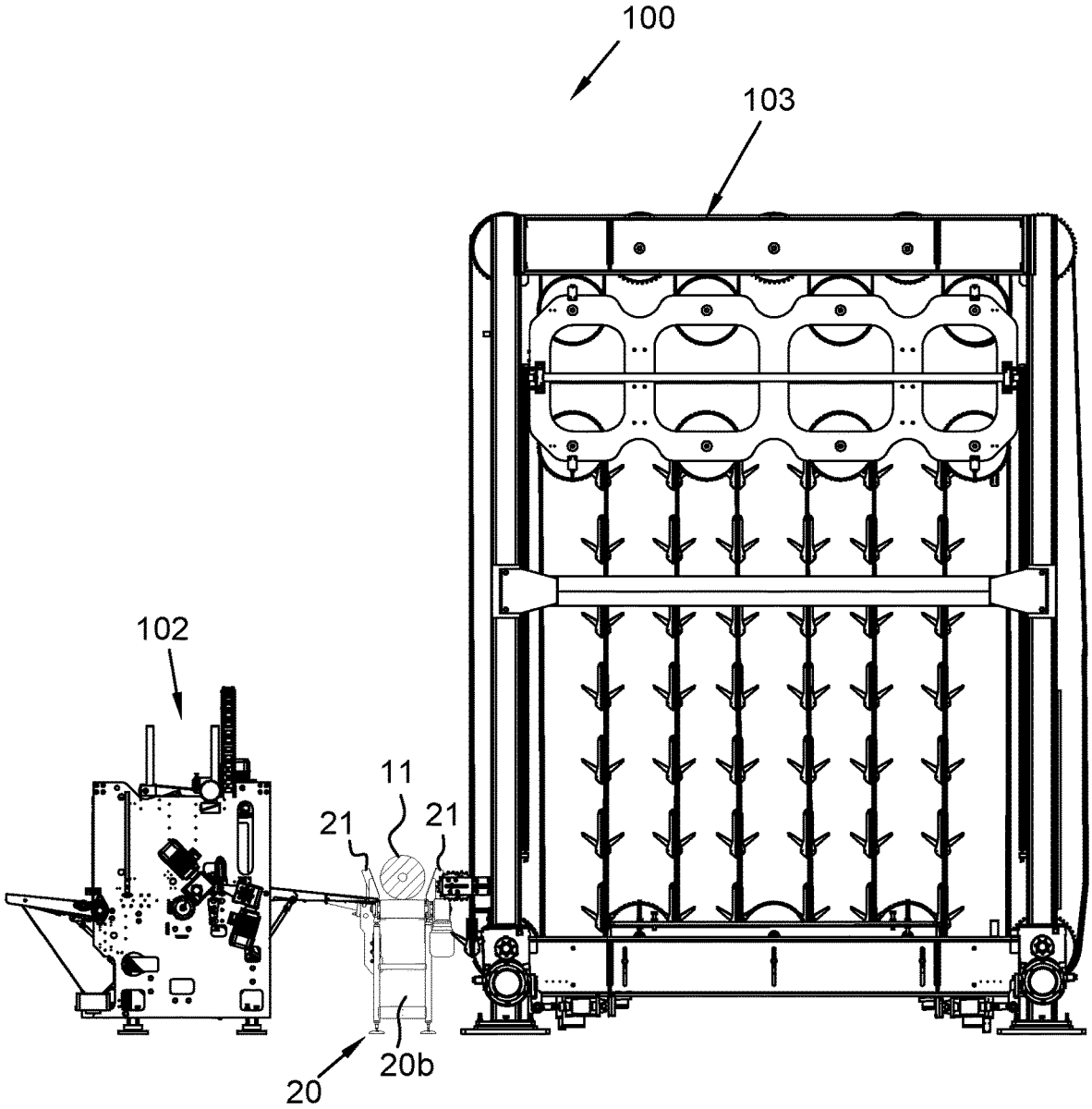
FIG. 1B is a side view of the converting line of FIG. 1A, in which the log has been shown by way of example, but the core gripping device has been omitted.
Figure 2A:
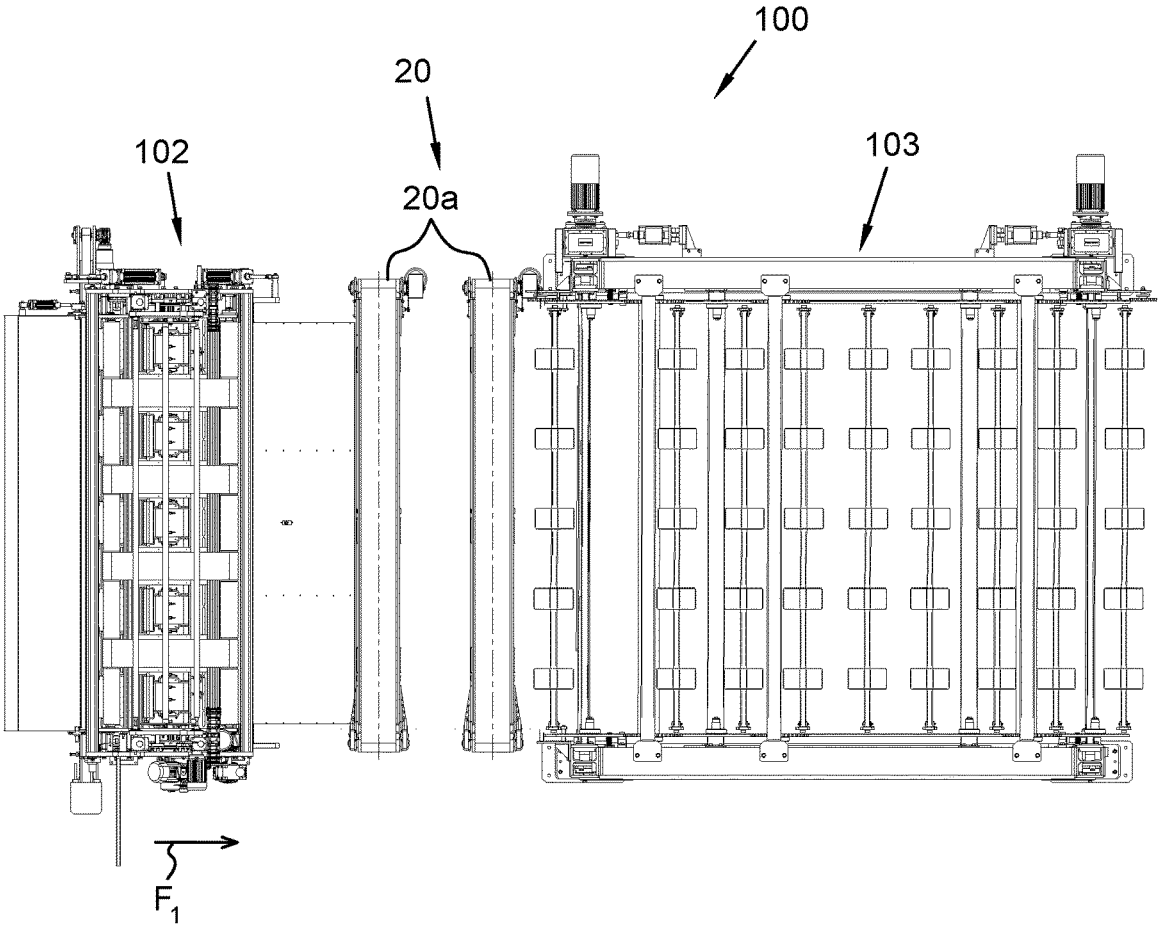
FIG. 2A is a schematic plan view of a part of a converting line having an extraction assembly of a core from a log, according to a further embodiment of the invention, in which the representation of the log has been omitted.
Figure 2A:
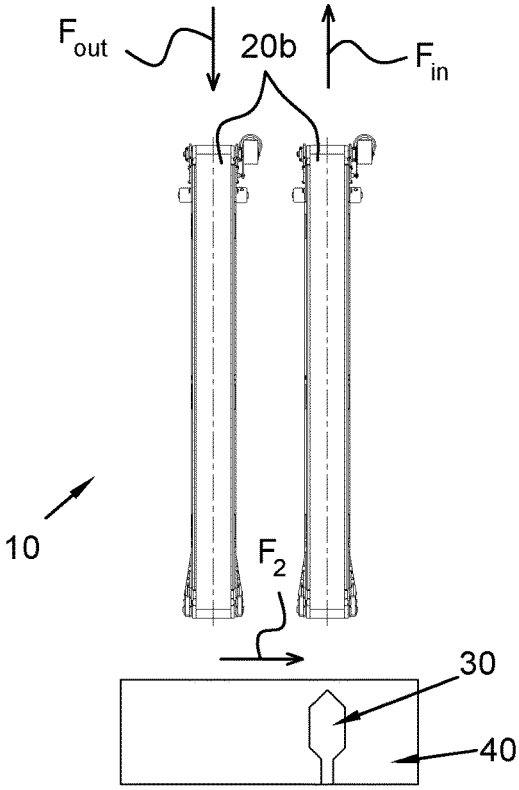

In FIGS. 1 and 2, by way of example, the converting line 100 has been schematically represented only through its parts directly interacting with the extraction assembly 10 of a core from a log object of the present invention, that is to say a final edge gluer 102, placed downstream of a rewinder, and a wound log accumulator of logs with closed final edge 103, placed upstream of a cutter.

The present invention uses a disintegrable core 12, such as for example a so-called "strippable" cardboard core of a known type, consisting of webs with reduced mutual adhesion and having weakening lines, which allow the breakage of the core 12 and its consequent transformation in a spiral strip 12', that is a "disintegrated core 12'", when subjected to traction after the conclusion of the winding of the paper about it.

According to the invention, disintegrable core means any core which, when subjected to traction, breaks in such a way that it can be entirely extracted in one or more parts from the wound log.

According to the invention, the disintegrable core 12 which is supplied to the rewinder of the converting line 100 must be longer than the width of the paper supplied and wound about it, so as to project by at least 1 cm, preferably by 2-3 cm, at least on one side of the paper wound to form a log 11.

The extraction assembly 10 comprises, according to the invention, rectilinear transport means 20 of the log 11 wound about a disintegrable core 12, a gripping device 30 for the portion of the core 12 projecting from the log 11 and a collection tank 40 of the disintegrated core 12'.

The rectilinear transport means 20 have a transverse transport direction with respect to the log advancement direction of the log 11 along the converting line 100, schematized in FIG. 1 with the arrow $F_1$. The transport takes place with alternate motion, back and forward, in the two opposite directions, as indicated by the arrows $F_{in}$ and $F_{out}$ of FIG. 1. The rectilinear transport means 20, according to the invention, comprise a first portion within the converting line 100 and a second portion outside the converting line 100, aligned with the first portion along the transverse transport direction.

According to the first embodiment shown in FIGS. 1A and 1B, the rectilinear transport means 20 comprise a first motorized belt 20*a* placed inside the converting line 100, i.e. placed directly inside the advancement path of the log 11, and a second motorized belt 20*b*, aligned with the first belt 20*a* in the transport direction and placed outside the advancement path of the log 11, at least partially external to the casing of the converting line in an area accessible by the machine operator.

According to the invention, the first motorized belt 20*a* placed along the advancement path of the log 11 can be the motorized belt that is often already predisposed in the traditional converting lines to extract single logs in case of need, for example for quality control needs, to which the second motorized belt 20*b* will be added to form the rectilinear transport means 20.

FIGS. 1A and 1B show, by way of example, two lateral sideboards 21 positioned as a funnel on the external motorized belt 20*b* and adapted to laterally contain the log during its stay outside the converting line 100. These sideboards are absent on the internal motorized belt 20*a* on which the log must transit along the advancement direction. In FIGS. 1A and 1B, on the other hand, the pusher and the stop means associated with the internal motorized belt 20*a* to hold the log on the belt, stopping its advancement movement and to send it towards the accumulator have been omitted.

According to further not shown embodiments, the rectilinear transport means 20 could also be made with a single motorized belt, as well as with other rectilinear transport systems.

Figure 2B:
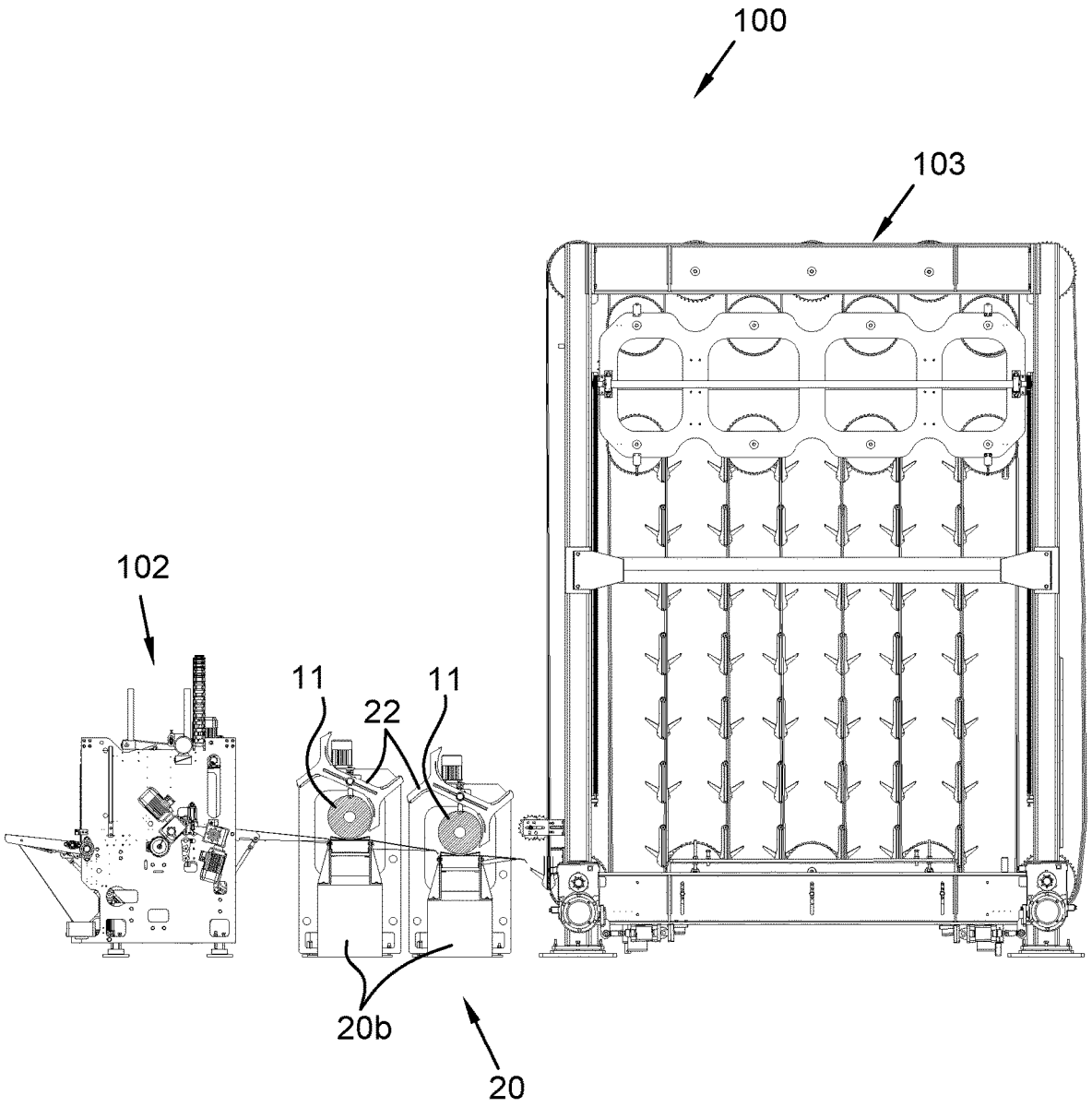
FIG. 2B is a side view of the converting line of FIG. 2A, in which the log has been shown by way of example, but the core gripping device has been omitted.

According to a further embodiment shown in FIGS. 2A and 2B, the rectilinear transport means 20 comprise a first pair of motorized belts 20*a* placed inside the converting line 100 and a second pair of motorized belts 20*b*, aligned with the first pair of belts 20*a* in the transport direction and located outside the advancement path of the log 11, at least partially external to the casing of the converting line in an area accessible by the machine operator.

FIG. 2B shows by way of example a pusher 22 associated with each of the motorized belts forming the first and second pair of external motorized belts 20*a*, 20*b*. The pusher 22 is hinged on an axis and is motorized to alternatively allow to hold the log 11 with respect to the advancement in direction $F_1$ or to transfer it downstream.

The gripping device 30 for the portion of the core 12 projecting from the log 11 is faced at one end of the rectilinear transport means 20, in particular at the free end, i.e. suitable for being placed outside the casing of the converting line, of the second conveyor belt 20*b*, and comprises a robotic gripper movable in the three dimensions of the space. The motorized gripper must in fact be able to axially grasp the core 12 at any point along the projecting circumference. In fact, the points of the space describing the circumference of the core vary when the diameter of the core 12 varies, as well as when the position of the log 11 on the second motorized belt 20*b* varies.

Furthermore, for example, to disintegrate the "strippable" core, one must preferably act by traction on the part having a pointed shape 112 at a weakening line, to facilitate the breakage of the core 12 to form a single strip 12' and not risk tearing the initial part without obtaining the spiral disintegration effect of the entire core.

According to a preferred embodiment, the robotic gripper can be made by means of a collaborative robot (a so-called "Cobot"), for example also equipped with a camera to identify the weakening points of the core 12 and carry out the gripping with precision near the tip 112, simulating the behaviour of a human hand.

According to the invention, both the second motorized belt 20*b* and the gripping device 30 and the collection tank 40 can be made as single elements independent of each other, which can be positioned so as to collaborate between them and with the converting line 100 if necessary. The gripping device 30 can advantageously be equipped with a system for resetting its spatial reference with the converting line in order not to require onerous calibration operations when put into operation.

According to the preferred embodiment of the invention, the extraction assembly 10 of a core from a log is provided between the final edge gluer 102 and the wound log accumulator 103. In this way, the manipulation of the log 11 for the extraction of the core 12 takes place when the log 11 is already closed and its final edge is no longer open, which might create problems of creases or damage to the product.

According to a further embodiment of the invention, the extraction assembly of a core from a log 10 could be placed upstream of the final edge gluer 102 between the same and the rewinder, not shown.

The operation of the extraction assembly 20 according to the invention, shown schematically in FIGS. 3A to 3D, provides that through the action of the rectilinear transport means 20, the log 11 wound about the core 12 is extracted with a rectilinear motion from the converting line 100 in direction $F_{out}$ transverse to the supply direction $F_1$ of the log in the line and is stopped near the gripping device 30.

The gripping device 30 clamps the core 12, in a perimeter point projecting from the wound paper, preferably near a tip 112, and holds it during the reverse rectilinear motion of the log 11, according to the arrow $F_{in}$, i.e. oriented towards the converting line 100, imposed by the transport means 20. The breakage of the core 12 is thus caused during its extraction from the moving log 11.

Figure 3A:
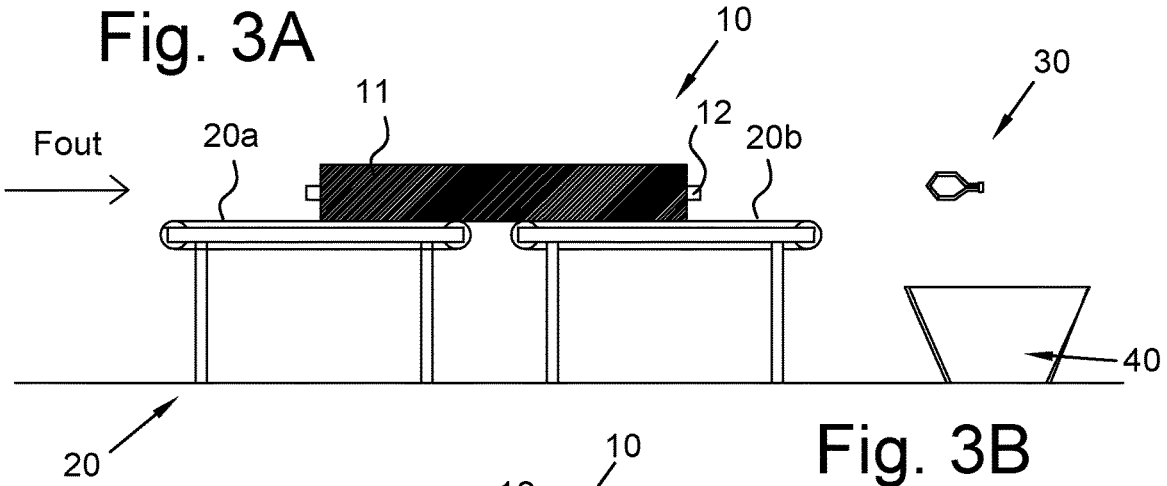
Figure 3B:
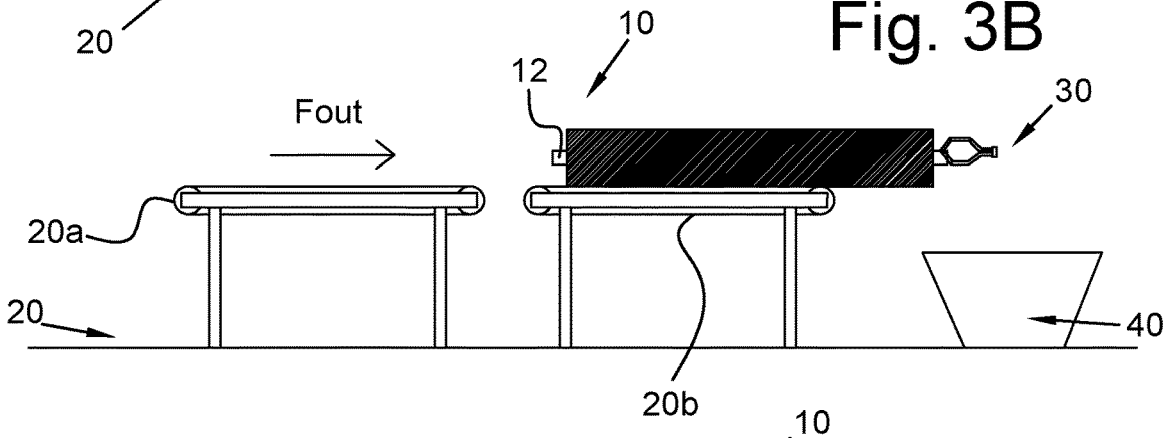
Figure 3C:
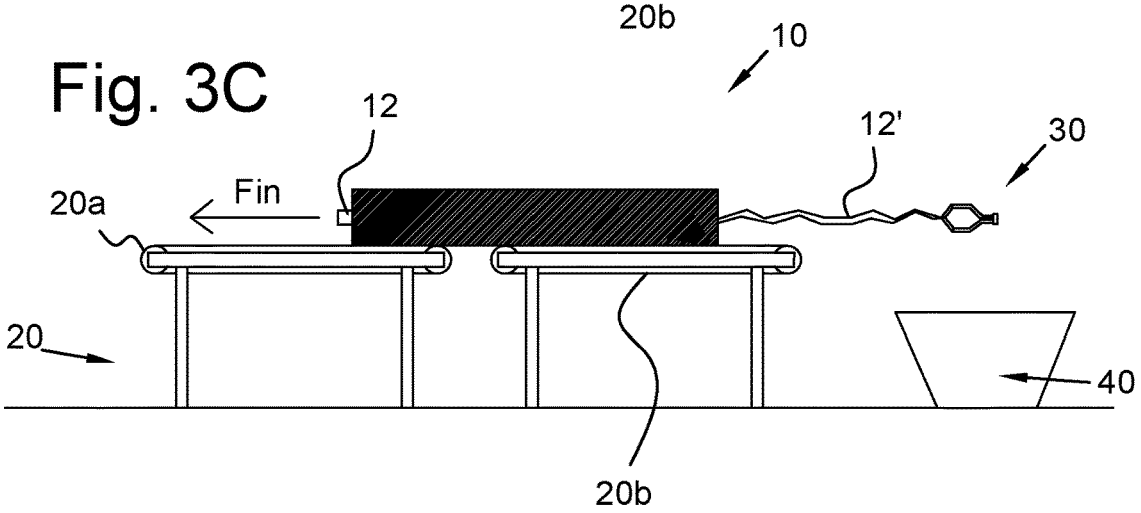
Figure 3D:
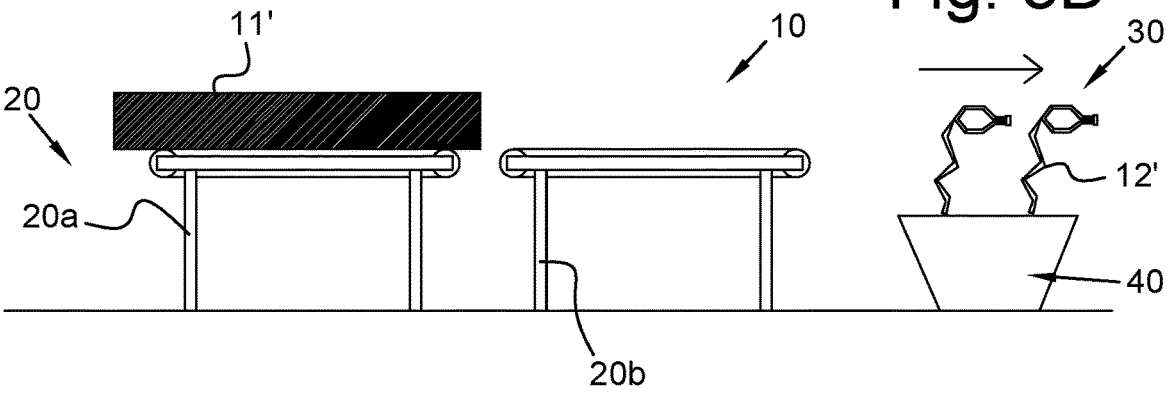

Preferably, an additional component of rectilinear motion actively imposed by the gripping means 30 moving away from the log 11 during its return motion inside the converting line, facilitates the complete extraction of the cardboard strip 12' and its deposit in the collection tank 40, avoiding the risk that the strip 12' itself can be transported towards the converting line 100 by the rectilinear transport means 20 or remains partially inside the log. In FIG. 3D, the robotic gripper 30 is schematically shown in two different positions, namely the gripping position on the core 12 and the position at the end of the movement away from the log 11, represented by an arrow.

A coreless log 11', i.e. deprived of the cardboard core 12, is then supplied back to the converting line 100 for cutting to size.

The spiral cardboard strips 12' can then be recovered and recycled, for example in the production of new cores, as they are entirely made of cardboard.

In the example of FIGS. 2A and 2B, the log 11 is extracted on the upstream belt in the advancement direction $F_1$ of the first pair of belts 20*a* and of the second pair of belts 20*b*. The extracted log is transferred by means of a pusher on the belt downstream of the second pair of belts 20*b* to which the robotic gripper 30 is associated. The reintroduction of the log 11 in the converting line 100 takes place on the belts downstream of the second and first pair of belts 20*b* while the robotic gripper 30 holds the clamped core and causes the disintegration of the core 12 and the extraction thereof from the wound paper log 11.

The arrangement of the motorized belts side by side in pairs in the advancement direction of the log advantageously allows to speed up the process, as it allows to carry out simultaneously the extraction steps of a log 11 from the converting line 100 and the extraction step of the core 12 from the log 11 extracted in the previous cycle.

The disintegrable core 12, which has been referred to as a cardboard core, could be replaced in an equivalent way for the invention by a disintegrable core of different material, even of plastic material, having the same behaviour when subjected to axial traction.

The method for producing a coreless log according to the invention includes winding the log 11 in the traditional way about a cardboard core 12 of the disintegrable type and extracting the cardboard core during the log production process, immediately after winding the log and before cutting the same into little rolls by means of the cutter.

The steps of the working method include:

- forming a log 11 by winding one or more tissue paper plies in a converting line on a disintegrable core 12, wherein the disintegrating core is projected with respect to the paper wound at least from a side;
- extracting the log formed from the supply path of the converting line in a transverse direction to bring it out of the converting line;
- clamping the core 12 in a set point of the projecting perimeter portion;
- reintroducing the log 11 in the supply path within the converting line in the transverse direction, in the opposite direction with respect to the extraction;
- maintaining the projecting perimeter portion of the core 12 tightened during the reintroduction step of the log 11, causing the disintegration of the core 12, as well as the extraction of the same from the log;
- possibly moving the gripping point loosening it from the converting line 100;
- collecting the disintegrated core 12' near the gripping means 30 and possibly sending it for recycling.

The steps of extracting the log 11 formed by the supply path of the converting line 100 according to a transverse direction to bring it out of the converting line 100 and the step of reintroducing the log 11 in the supply path within the converting line 100 in the transverse direction and in the opposite direction with respect to extraction can be carried out simultaneously on two successive logs placed side by side.

The extraction assembly of a core from a log has the advantage of being applicable to already existing converting lines so as to adapt the same to the production of coreless rolls.

An advantage of the converting line according to the invention is that it can be converted from the production of coreless rolls to the production of traditional rolls with a core according to the production needs, with minimal adjustment.

Advantageously, the component parts of the extraction assembly are simple and inexpensive.

The absence of plastic spindles, in addition to simplifying the operation of the coreless converting line, reduces the environmental impact of the same, as well as the need for additional maintenance.

The method for producing a coreless log object of the present invention have the advantage of carrying out simple steps, easily repeatable with a high degree of reliability. The risks of product rejection, for example due to an accidental breakage of the core inside the log and only partial removal of the same, are advantageously minimized.

The extraction assembly of a core from a log, the converting line having said assembly and the method for producing a coreless log thus conceived are susceptible of numerous modifications and variations, all of which are within the scope of the invention; furthermore, all the details can be replaced by technically equivalent elements. In practice, the materials used, as well as the dimensions thereof, can be of any type according to the technical requirements.

The invention claimed is:

1. An extraction assembly, comprising:

a rectilinear transporter of a log wound about a disintegrable core; and a gripping device for a portion of the core projecting from the log, wherein:

the rectilinear transporter has a transverse transport direction with respect to a log advancement direction of the log along a converting line, and has an alternating transport direction back and forth in opposite directions;

the rectilinear transporter comprises a first portion for being received within the converting line, and a second portion for being placed outside the converting line, in which the second portion is aligned with respect to the first portion along the transverse transport direction; and the first portion and the second portion of the rectilinear transporter comprise a first motorized belt and a second motorized belt each having an alternating motion.

2. The extraction assembly according to claim 1, wherein:

the first portion and the second portion of the recti linear transporter comprise a first pair of motorized belts and a second pair of motorized belts, each of the motorized belts having an alternating motion; and belts of the first pair and belts of the second pair are placed side by side each other along the log advancement direction, such that a pushing element is provided for transferring the log between the belts of second pair of belts.

3. The extraction assembly according to claim 1, wherein the gripping device faces one end of the rectilinear transporter.

4. The extraction assembly according to claim 3, wherein the gripping device comprises a robotic gripper that is movable along three spatial dimensions.

5. The extraction assembly according to claim 4, wherein the gripping device is a Cobot.

6. An extraction assembly, comprising:

a rectilinear transporter of a log wound about a disintegrable core; and a gripping device for a portion of the core projecting from the log, wherein:

the rectilinear transporter has a transverse transport direction with respect to a log advancement direction of the log along a converting line, and has an alternating transport direction back and forth in opposite directions; and the rectilinear transporter comprises a first portion for being received within the converting line, and a second portion for being placed outside the converting line, in which the second portion is aligned with respect to the first portion along the transverse transport direction, the extraction assembly further comprising:

a collection tank for collecting spiral strips making up separable cores in an open configuration.

7. The extraction assembly according to claim 6, wherein the gripping device faces one end of the rectilinear transporter.

8. The extraction assembly according to claim 7, wherein the gripping device comprises a robotic gripper that is movable along three spatial dimensions.

9. The extraction assembly according to claim 8, wherein the gripping device is a Cobot.

10. A converting line, comprising a final edge gluer and a closed log accumulator, and having an extraction assembly comprising:

a rectilinear transporter of a log wound about a disintegrable core; and a gripping device for a portion of the core projecting from the log, wherein:

the rectilinear transporter has a transverse transport direction with respect to a log advancement direction of the log along a converting line, and has an alternating transport direction back and forth in opposite directions;

the rectilinear transporter comprises a first portion and a second portion aligned with respect to the first portion along the transverse transport direction; and the first portion of the rectilinear transporter is situated in series with units along a supplying log direction ($F_1$).

11. The converting line according to claim 10, wherein the extraction assembly is situated between the final edge gluer and the closed log accumulator.

12. The converting line according to claim 10, wherein the first portion and the second portion of the rectilinear transporter comprise a first motorized belt and a second motorized belt, each having an alternating motion.

13. The converting line according to claim 12, wherein:

the first portion and the second portion of the rectilinear transporter comprise a first pair of motorized belts and a second pair of motorized belts, each of the motorized belts having an alternating motion; and belts of the first pair and belts of the second pair are placed side by side each other along the log advancement direction, such that a pushing element is provided for transferring the log between the belts of second pair of belts.

14. The converting line according to claim 10, wherein the gripping device faces one end of the rectilinear transporter.

15. The converting line according to claim 14, wherein the gripping device comprises a robotic gripper that is movable along three spatial dimensions.

16. The converting line according to claim 15, wherein the gripping device is a Cobot.

17. The converting line according to claim 10, the extraction assembly further comprising a collection tank for collecting spiral strips making up separable cores in an open configuration.

18. A method for producing a coreless log, the method comprising:

forming a log by winding one or more tissue paper plies on a disintegrable core, wherein the disintegrable core is projected with respect to the paper plies wound at least from a log side;

extracting the log from a supply path along a transverse direction;

clamping the disintegrable core in a set point of a projecting perimeter portion;

reintroducing the log in the supply path along a transverse direction that is in an opposite direction with respect to the extracting;

and maintaining a core projecting portion tightened during the reintroducing of the log, thereby causing disintegration of the core to obtain at least one strip that is extracted from the log.

19. The method according to claim 18, further comprising:

moving away a gripping point on the core with respect to the log by a movement opposed to the reintroducing of the log; and collecting the at least one strip of disintegrated core.

20. The method according to claim 18, wherein the extracting of the log from the supply path along the transverse direction, and the reintroducing of the log in the supply path in the transverse direction that is in the opposite direction with respect to the extracting, occur simultaneously on two logs placed side by side each other.

* * * * *